United States Patent [19]

Melton

[11] Patent Number: 4,705,270

[45] Date of Patent: Nov. 10, 1987

[54] PORTABLE EXERCISE DEVICE

[76] Inventor: Florence Melton, 1000 Urlin Ave., Columbus, Ohio 43212

[21] Appl. No.: 836,558

[22] Filed: Mar. 6, 1986

[51] Int. Cl.[4] ..... A63B 23/00

[52] U.S. Cl. ..... 272/93; 272/900; 272/145

[58] Field of Search ..... 272/93, 900, 104, 61, 272/145

[56] References Cited

U.S. PATENT DOCUMENTS

| | | | |
|---|---|---|---|
| 938,045 | 10/1909 | Fay | 272/900 |
| 3,734,493 | 5/1973 | Hasekian | 272/93 |
| 4,121,825 | 10/1978 | Hult | 272/900 |
| 4,473,227 | 9/1984 | Klaus | 273/DIG. 30 |
| 4,591,148 | 5/1986 | Slater | 273/DIG. 30 |
| 4,593,902 | 6/1986 | Michaelsen | 272/900 |
| 4,602,782 | 7/1986 | Carlson | 272/900 |

FOREIGN PATENT DOCUMENTS

| | | | |
|---|---|---|---|
| 2544617 | 10/1984 | France | 272/900 |

*Primary Examiner*—Richard J. Apley
*Assistant Examiner*—S. R. Crow
*Attorney, Agent, or Firm*—Watson, Cole, Grindle & Watson

[57] ABSTRACT

An exercise device adapted to extend beneath a door and provide an anchor for one or more body parts of an individual performing exercises. The device comprises an elongated body having a major length and including a rigid element enclosed in a flexible cover. The device further includes two straps extending generally transverse to the major length of the body. Both ends of each strap are secured to the body to thereby form a loop and at least one end of each strap is releasably secured to the body by a hook-and-loop type fastener of sufficient dimensions that the size of the loop can be varied.

5 Claims, 4 Drawing Figures

PORTABLE EXERCISE DEVICE

FIELD OF THE INVENTION

The present invention relates to exercise devices and, more particularly, to exercise devices which are capable of engaging the bottom of a door and providing a floor level anchor for the feet of an exerciser engaging in floor exercises such as sit-ups, or those carried out in a reverse body position, for example.

BACKGROUND OF THE INVENTION

When many individuals are performing sit-up type floor exercises as part of an exercise regimen, it is oftentimes difficult to maintain a proper sit-up position where the legs and/or feet are in contact with the floor. While the individual can extend his feet beneath a heavy object such as a piece of furniture or can enlist the aid of an assistant to maintain the feet in contact with the floor, these expedients are not always available and may be somewhat uncomfortable to the individual.

Various devices have been developed over the years in attempts to enable the individual to properly and comfortably perform sit-up type exercises. Many of these devices are of the type which engage the lower portion of a door to provide an anchor for the one or more of the individual's feet. An example of such a device is shown in U.S. Pat. No. 2,050,652 to Fleming which comprises a pair of steel stirrups which are releasably secured by a pair of screws in the space between the bottom of a door and the floor. Other anchoring devices for sit-up type exercises which have foot engaging means mounted on U-shaped brackets which are adapted to be secured to the bottom of a door by clamping means are disclosed in U.S. Pat. Nos. 4,116,434 and 4,185,816 to Bernstein; U.S. Pat. No. 4,212,458 to Bizilia; and U.S. Pat. No. 4,468,022 to Wu. Additional devices for facilitating sit-up type exercises which are adapted to engage the lower portion of a door are disclosed in U.S. Pat. No. 4,121,825 to Hult; U.S. Pat. No. 4,176,835 to Aziz; U.S. Pat. No. 4,417,726 to Schleis and French Pat. No. 2,544,617 to Moreno.

While all of these devices would appear to function satisfactorily for their intended purposes, the devices seem to suffer from at least one drawback of less than desired comfort for the user, complexity in installation, potential damage to the door surfaces and/or inability to easily adjust the devices to comfortably fit a variety of users. In addition, these devices may not be easily portable such that the device could not be easily taken along when travelling.

SUMMARY OF THE INVENTION

It is therefore a feature of the present invention to provide an exercise device adapted to enable a user to more easily perform sit-up type exercises which is characterized by ease of installation, portability, adjustability to fit various users and a construction which minimizes or eliminates damage to door surfaces.

Briefly, the present invention comprehends an exercise device adapted to extend beneath a door and provide an anchor for one or more body parts of an individual performing exercises, the device comprising an elongated body having a major length and including a rigid element enclosed in a flexible cover, and two straps extending generally transverse to the major length of the body, both ends of each strap being secured to the body to thereby form a loop and at least one end of each strap being releasably secured to the body by a hook-and-loop type fastener of sufficient dimensions that the size of the loop can be varied.

Further objects, advantages and features of the present invention will become more fully apparent from a detailed consideration of the arrangement and construction of the constituent parts as set forth in the following description taken together with the accompanying drawing.

DETAILED DESCRIPTION OF THE PREFERRED EMBODIMENTS

Figure 2:
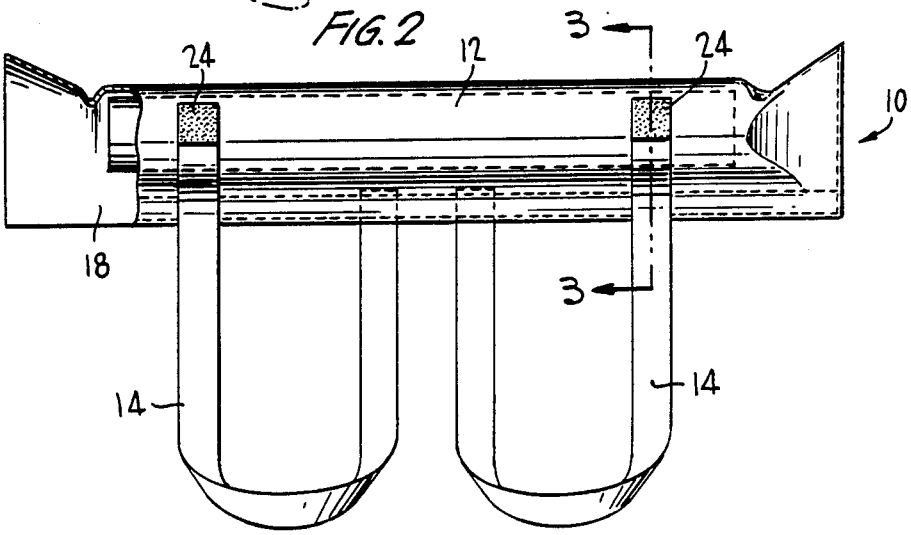
FIG. 2 is a top plan view of an embodiment of an exercise device according to the invention.
Figure 3:
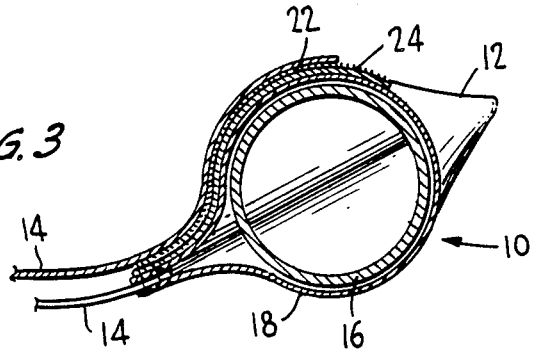
FIG. 3 is a cross-sectional view of the device taken along line 3—3 of FIG. 2.

Referring first to FIGS. 2 and 3, shown is exercise device 10 in accordance with the present invention. Device 10 comprises a generally elongated body 12 and two attached loop-like foot straps 14 extending from one side of the body. As is best shown in FIG. 3, elongated body 12 is composed of rigid tubular element 16 enclosed within flexible cover 18 formed from a sheet folded upon itself and sewn together about its edges to provide a closed envelope about the element.

Elongated body 12 has a major length which is equal to or less than the width of an average sized door and has a thickness substantially greater than the space normally found beneath a door. Element 16, for economic reasons, is preferably formed of a cardboard type tube.

Loop-like foot straps 14 of exercise device 10 are made of flexible cloth-like material, one end of each strap being securely sewn between edges of the sheet forming cover 18. The other end of each strap 14 is provided with one portion 22 of a hook-and-loop type releasable fastener of the type sold under the tradename Velcro. A complementary portion 24 of the fastener is affixed to cover 18 to enable this end of each strap 14 to be releasably secured to the cover. Portions 22 and 24 of the hook-and-loop type fastener are of sufficient dimensions that straps 14 remain securely affixed to elongated body 12 under the normal stress applied by a user of device 10. In addition, portions 22 and 24 are also of sufficient dimensions such that the size of the loops formed by straps 14 can be varied significantly such that the loops can comfortably accommodate body portions of various sizes.

Figure 1:
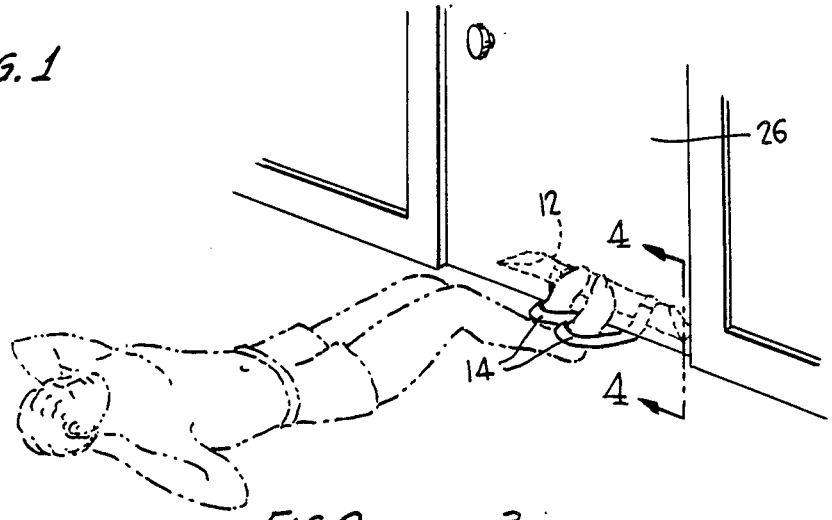
FIG. 1 is a perspective view of an individual using the exercise device of the invention.
Figure 4:
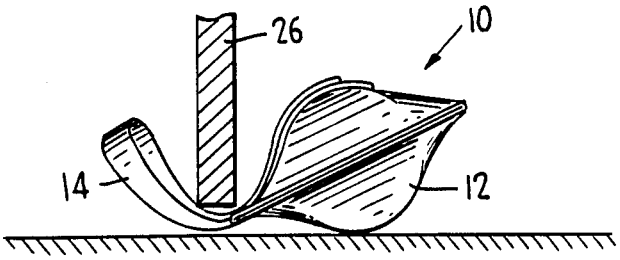
FIG. 4 is an end view of the device with associated door as taken along line 4—4 of FIG. 1.

The installation and use of exercise device 10 is illustrated in FIGS. 1 and 4. As is shown in FIG. 4, exercise device 10 is placed adjacent to the bottom of open door 26 with elongated body 12 on one side of the door and straps extending beneath the door to the other side. The user then, as is shown in FIG. 1, closes door 26 and lies on the floor and inserts his feet into straps 14. If the length of straps 14 is such that either of the feet do not fit properly to provide a snug yet comfortable anchor for the feet, device 10 may be easily removed and the length of the straps adjusted by repositioning portion 22 of the fastener relative to complementary portion 24. Once straps 14 are properly adjusted, device 10 is reinstalled about the bottom of open door 26, the door closed and the feet reinserted in straps 14. The user can then commence sit-up type exercises with his feet securely anchored.

Although device 10 has been described above with reference to its use as a foot anchor in performing sit-up type exercises, the device can also be used in other manners. For example, a user can lie on his back with his head adjacent to device 10 installed beneath door 26, grasp straps 14 with his hands and perform various exercises such as leg-lifts with less strain.

As is apparent from the above description, the exercise device of the present invention is readily installed about a door, is easily adjustable so as to provide a comfortable fit about the body parts of a user and is relatively simple in construction. Furthermore, the device provides a solid and safe anchor for the user when performing sit-up type exercises and the like.

While there has been shown and described what is considered to be a preferred embodiment of the present invention, it will be obvious to those skilled in the art that various changes and modifications may be made therein without departing from the invention as defined in the appended claims.

It is claimed:

1. An exercise device adapted to extend beneath a door and provide an anchor for one or more body parts of an individual performing exercises, the device comprising an elongated body having a major length and including a rigid element enclosed in a flexible cover, and two straps extending generally transverse to the major length of the body, both ends of each strap being secured directly to the body to thereby form a loop for the reception of the one or more body parts of the individual performing exercises, at least one end of each strap including one portion of a hook-and-loop type releasable fastener, said body having a complementary portion of a hook-and loop type releasable fastener affixed to the cover for each said one portion, each said complementary portions being elongated and extending essentially transverse to the major length of the elongated body and extend a sufficient length so as to engage a door bottom surface, each said one portion capable of engaging each said complementary portions for releasably securing said one end of each said strap to said elongated body, said complementary portions being located on said cover such that when the device is extended beneath a door, force exerted on said straps by the individual results in the one fastener portion being pressed against the complementary fastener portion by wedging action with the door bottom surface, and said portions of each said fastener being of sufficient dimensions that the size of each loop can be varied.

2. An exercise device in accordance with claim 1, wherein the element is cylindrical.

3. An exercise device in accordance with claim 2, wherein the element is a tube.

4. An exercise device in accordance with claim 3, wherein the element is a cardboard tube.

5. An exercise device in accordance with claim 1, wherein the cover is a sheet folded on itself and sewn about the edges.

* * * * *